US005662279A

United States Patent [19]

Czekai et al.

[11] Patent Number: 5,662,279

[45] Date of Patent: Sep. 2, 1997

[54] PROCESS FOR MILLING AND MEDIA SEPARATION

[75] Inventors: David Alan Czekai, Honeoye Falls; Larry Paul Seaman, Mt. Morris; Dennis Edward Smith, Rochester, all of N.Y.

[73] Assignee: Eastman Kodak Company, Rochester, N.Y.

[21] Appl. No.: 567,794

[22] Filed: Dec. 5, 1995

[51] Int. Cl.[6] ..... B02C 17/16

[52] U.S. Cl. ..... 241/21; 241/24.11; 241/171; 241/172; 241/184

[58] Field of Search ..... 241/171, 172, 241/21, 24.11, 184

[56] References Cited

U.S. PATENT DOCUMENTS

| | | |
|---|---|---|
| 3,104,068 | 9/1963 | Castelll et al. . |
| 3,313,491 | 4/1967 | Lucchini et al. . |
| 3,601,322 | 8/1971 | Szegvari . |
| 3,713,593 | 1/1973 | Morris et al. . |
| 3,998,938 | 12/1976 | Szegvari . |
| 4,044,957 | 8/1977 | Schold . |
| 4,056,230 | 11/1977 | Decobert . |
| 4,065,060 | 12/1977 | Booz . |
| 4,065,061 | 12/1977 | Bombled . |
| 4,140,283 | 2/1979 | Szkaradek . |
| 4,262,851 | 4/1981 | Graser et al. . |
| 4,394,981 | 7/1983 | Schold . |
| 4,404,346 | 9/1983 | Pirotta et al. . |
| 4,441,658 | 4/1984 | Szkaradek . |
| 4,474,872 | 10/1984 | Onishi et al. . |
| 4,624,418 | 11/1986 | Szkaradek . |
| 4,629,133 | 12/1986 | Bühler . |
| 4,651,935 | 3/1987 | Samosky et al. . |
| 4,673,134 | 6/1987 | Barthelmess ..... 241/172 X |
| 4,709,863 | 12/1987 | Szkaradek et al. . |
| 4,742,966 | 5/1988 | Szkaradek et al. . |
| 4,940,654 | 7/1990 | Diehl et al. . |
| 4,974,368 | 12/1990 | Miyamoto et al. . |
| 4,998,678 | 3/1991 | Dürr . |
| 5,066,335 | 11/1991 | Lane et al. . |
| 5,066,486 | 11/1991 | Kamen et al. . |
| 5,145,684 | 9/1992 | Liversidge et al. . |
| 5,158,239 | 10/1992 | Vock et al. . |
| 5,320,284 | 6/1994 | Nishida et al. . |

FOREIGN PATENT DOCUMENTS

| | | |
|---|---|---|
| 247 895 | 12/1987 | European Pat. Off. . |
| 498 482 | 8/1992 | European Pat. Off. . |
| 600 528 | 6/1994 | European Pat. Off. . |
| 273 210 | 11/1989 | Germany . |
| 580 211 | 3/1977 | U.S.S.R. . |
| 850668 | 10/1960 | United Kingdom ..... 241/172 |
| 969564 | 9/1964 | United Kingdom ..... 241/171 |

OTHER PUBLICATIONS

Drukenbrod, "Smaller Is Better?", Paint & Coatings Industry, Dec. 1991, p. 18.

*Primary Examiner*—Mark Rosenbaum
*Attorney, Agent, or Firm*—Andrew J. Anderson

[57] ABSTRACT

A method of preparing milled solid particles of a compound comprises the steps of forming a slurry of a liquid medium, the compound and rigid milling media in a milling chamber, contacting the compound with the milling media while in the chamber to reduce the particle size of the compound, and thereafter separating the compound from the milling media by vacuum filtration through a removable filter probe immersed in the slurry. In a preferred embodiment, the milling media is a polymeric resin having a mean particle size of less than 300 μm. The method enables the use of fine milling media which provides extremely fine particles of the compound while avoiding problems, e.g., decrease yields due to separator screen plugging, associated with prior art processes.

20 Claims, 1 Drawing Sheet

PROCESS FOR MILLING AND MEDIA SEPARATION

FIELD OF THE INVENTION

This invention relates to a milling process using milling media for obtaining small particles of a material, such as compounds useful in imaging elements, and separation of the resulting milled compounds from the milling media.

BACKGROUND OF THE INVENTION

Fine solid particle dispersions of compound useful in imaging can be prepared by mixing together a coarse slurry of a solid compound of interest in a liquid, with or without a dispersing aid and a binder, followed by milling where repeated collisions of milling media with the solid compound in the slurry result in fracture and resultant particle size reduction. The mill used to accomplish particle size reduction can be for example a colloid mill, swinging mill, ball mill, media mill, attritor mill, jet mill, vibratory mill, high pressure homogenizer, etc. These methods are described, e.g., in U.S. Pat. Nos. 4,006,025, 4,294,916, 4,294,917, 4,940,654, 4,950,586 and 4,927,744, and UK 1,570,362. The mill can be charged with the appropriate media such as, for example, sand, spheres of silica, stainless steel, silicon carbide, glass, zirconium, zirconium oxide, alumina, titanium, polymeric media such as cross-linked polystyrene beads, etc. The media sizes typically range from 0.25 to 3.0 mm in diameter, but smaller milling media, e.g. media having a mean particle size less than 100 microns, may also be used. After reduction to a desired particle size, the compound of interest is separated from the milling media. Milling processes may be performed batchwise or in a continuous process manner.

Conventional mills used for size reduction in a continuous mode usually incorporate a means for retaining milling media in the milling zone of the mill (e.g., milling chamber) while allowing passage of the dispersion or slurry through the mill in either a recirculation or discrete pass mode. Such means for simultaneous milling and media separation is described as "dynamic media separation". Various techniques have been established for retaining media in these mills, including rotating gap separators, screens, sieves, centrifugally-assisted screens, and similar devices to physically restrict passage of media from the mill. Batch processes such as ball mills (eg. Abbe Ball Mills) or stirred ball mills (eg. Union Process Attritor) perform separation of dispersion and milling media after milling is complete, usually through a screen or sieve sized smaller than the milling media. Typically, the screen is affixed to the milling vessel and slurry is removed by gravity drainage or pumped out of the vessel. Alternatively, the slurry may be forced from the vessel by charging the vessel with compressed gas.

Over the last ten years there has been a transition to the use of small milling media in conventional media mill processes for the preparation of various paints, pigment dispersions and photographic dispersions. This transition has been made possible due primarily to the improvements in high speed media mill designs (eg. Netzsch LMC mills and Drais DCP mills) which allow the use of media as small as 250 μm. The advantages of small media include more efficient comminution (i.e. faster rates of size reduction) and smaller ultimate particle sizes. While the use of media having a size less than 300 μm, especially between 25 and 100 μm, has been found to provide optimal size reduction as disclosed in copending, commonly assigned U.S. patent application Ser. No. 08/248,774 filed May 25, 1994, the disclosure of which is hereby incorporated by reference, even with the best machine designs available, it has been found difficult to use such media due to separator screen plugging and unacceptable pressure build-up due to hydraulic packing of the media. In fact, for most commercial applications, 350 μm media is considered the practical lower limit for most systems due to media separator screen limitations. In copending, commonly assigned U.S. patent application Ser. No. 08/248,782 filed May 25, 1994, the disclosure of which is hereby incorporated by reference, it is disclosed that the problems of separator screen plugging and unacceptable pressure build up due to hydraulic packing of the media during milling can be avoided by 1) adjustment of the media separator to allow passage of media through the separator, and 2) providing a means of continuous recirculation of the media/product mixture throughout the process, wherein the media and product are separated from each other outside of the milling chamber.

PROBLEM TO BE SOLVED BY THE INVENTION

It would be desirable to provide an improved milling and media separation process, particularly for use with media smaller than 300 μm, wherein the media is not removed from the milling chamber. It is an object of the invention to provide a milling process capable of making ultra-fine particle dispersions with weight average particle sizes less than 100 μm. It is a further object to provide a milling process which enables the use of milling media less than 100 μm in weight average size whereby such media is separated from ultra-fine particle dispersions without plugging of a media separator. It is a further object to provide a milling process in which milling media is not removed from the milling vessel to accomplish media/dispersion separation.

SUMMARY OF THE INVENTION

We have discovered a process for milling and media separation wherein the above objectives are achieved through use of vacuum removal of a milled particle dispersion through a removable vacuum filter probe which is manually or automatically immersed in a media/dispersion mixture.

In accordance with one embodiment of the invention, a process for forming a dispersion of solid particles of a compound is disclosed comprising: (a) forming a slurry of a liquid medium, milling media, and a solid compound, (b) contacting said milling media and said compound in a milling chamber of a milling vessel to reduce the solid compound to a desired average particle size to form a dispersion of milled solid particles in said liquid medium, and (c) separating said dispersion of milled particles from said milling media in said milling chamber by vacuum filtration through a removable filter probe immersed in the slurry.

In preferred embodiments of the invention, milling is performed by high speed mixing of the dispersion/media mixture in the milling chamber, milling step (b) is performed in the absence of the removable filter, and separating step (c) is performed with a removable filter immersed into the slurry after the solid compound is reduced to a desired particle size.

ADVANTAGEOUS EFFECT OF THE INVENTION

By this process, milling and media separation may be decoupled, eliminating media separator screen plugging during milling. In the event the filter probe becomes plugged, it is easily removed from the dispersion/media mixture for cleaning or replacement. Unlike conventional media separation processes, there is minimal loss of dispersion associated with filter cleaning.

Extremely small media (e.g., less than 300 μm) may be effectively separated using this process. Larger media (e.g., greater than 300 μm) may also be used. The milling media need not be removed from the vessel, thereby minimizing handling and chances for contamination. The filter element may be sized to accomplish both media separation and purification of the dispersion (i.e. exclusion of larger, undesirable particles) in one step. Very large filter surface area can be used to maximize rate of dispersion removal from the dispersion/media mixture.

Unlike conventional separation techniques, the separator filter probe is not physically attached to the milling vessel, and it can be positioned in a variety of configurations for optimal effect. Delayed filter introduction avoids contact between filter screen and media/dispersion mixture until dispersed particles are reduced to a size below which would plug the filter screen. Typically, such particles can equal or exceed filter screen dimensions and easily deposit in screen openings and lead to plugging.

DETAILED DESCRIPTION OF THE INVENTION

Figure 1:
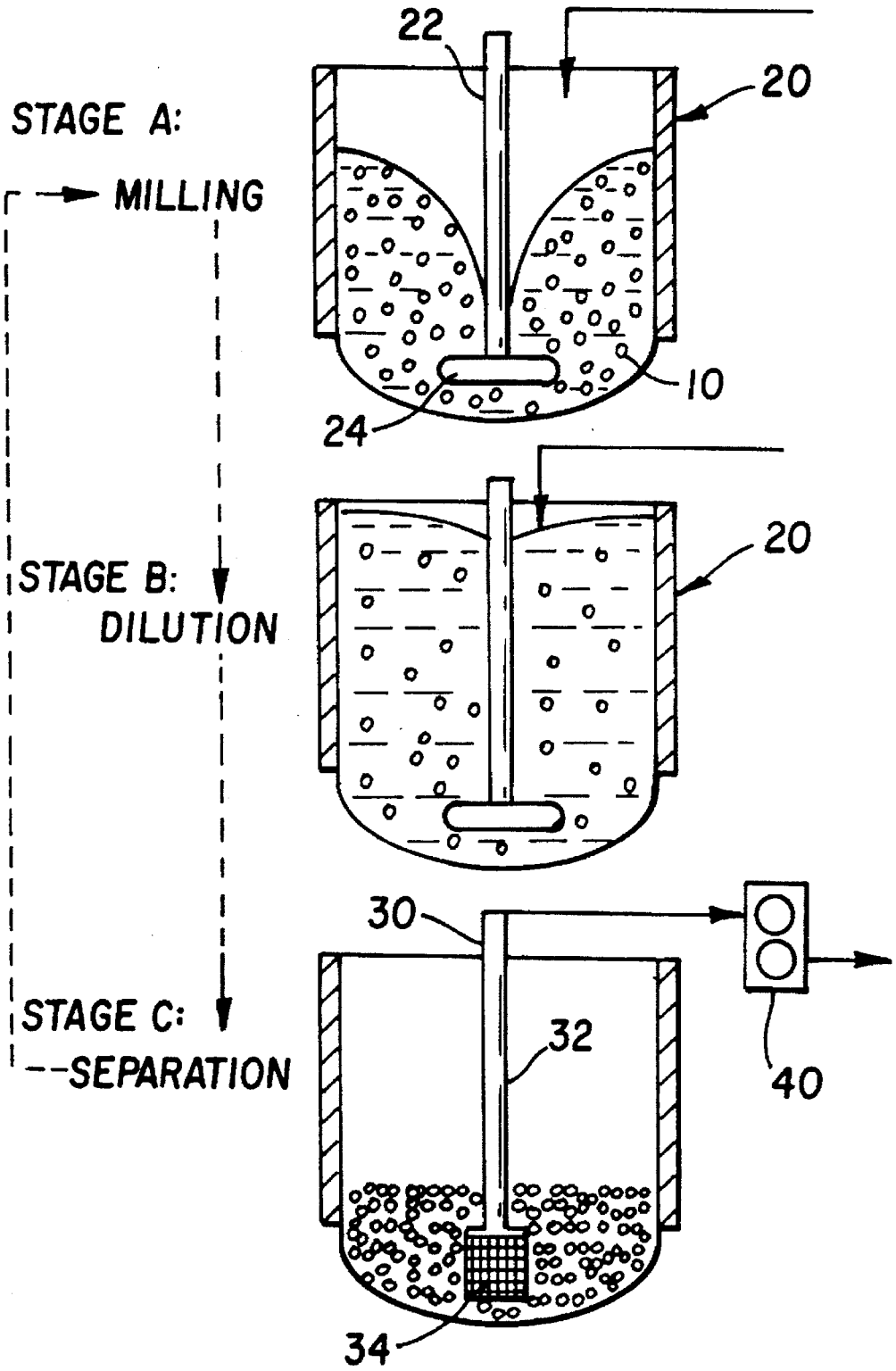
FIG. 1 is a schematic view of a preferred embodiment of a milling process in accordance with this invention.

This invention is directed to milling materials, such as pigments for paints, pharmaceutical compounds, and compounds useful in imaging elements, to obtain extremely fine particles thereof. Compounds useful in imaging elements refers to compounds that can be used in photographic elements, electrophotographic elements, thermal transfer elements, and the like. While this invention is described primarily in terms of its application to such compounds, it is to be understood that the invention can be applied to milling a wide variety of materials.

In accordance with the invention, a process for the formation of solid particle dispersions of compounds is disclosed including the steps of formation of a slurry of a compound to be milled and a liquid vehicle, milling of the compound slurry using milling media in a vessel to form a particulate dispersion, and separating the resulting dispersion of milled particles and liquid vehicle from the milling media in the vessel.

Milling media/milled particle dispersion separation is accomplished in accordance with the invention through use of a removable filter probe immersed into the media/dispersion mixture. Preferably, the filter probe is not immersed into the mixture until after milling is complete or after sufficient particle size reduction has occurred so as to prevent filter screen plugging.

The filter probe may comprise, e.g., a screen covering an end of a conduit through which the dispersion is removed. After immersion of the filter probe, a vacuum is generated within the conduit by means of a suitable pump, and the dispersion is discharged from the milling vessel through the filter screen and conduit. The filter pore size is selected depending on the size of media used, the maximum filter pore size being smaller than the minimum media particle size to prevent blinding of the pores.

Suitable filter compositions include metal, plastic, fiberglass, natural and synthetic membranes. Filter geometry may include square mesh, woven mesh, slots, sintered fibers, holes, etc. It is desirable to maximize the filter surface area to provide efficient dispersion removal. Rigid filters such as metal slotted filters are preferred due to tolerance to high vacuums.

Self-priming pumps capable of generating at least 1.5 m $H_2O$ vacuum are preferred. Examples of such pumps include diaphragm pumps, peristaltic pumps and positive displacement pumps. The filter probe may be attached to the pump by either rigid or flexible tubing, although flexible tubing improves ease of filter positioning and removal. The rate of dispersion removal may be regulated by selection of filter type, filter area and vacuum level. Typical removal rates range from 1 to 10 kg/min. With this technique, very high dispersion discharge yields are obtained, as most of the interstially-trapped dispersion is removed. Typical removal yields range from 95–99% of initial dispersion volume. Residual dispersion heel may then be incorporated into subsequent batches, thereby maximizing overall process yield.

With reference to FIG. 1, the process of this invention in accordance with a preferred embodiment can be carried out as follows. In Stage A, the compound to be milled, liquid medium, and rigid milling media 10 are combined in milling vessel 20 which, as illustrated, contains rotating shaft 22 and mixing blade 24, where the compound is milled to a dispersion of the compound having a desired particle size in the liquid medium. Subsequently, the dispersion is diluted in Stage B, and filter probe 30 comprising conduit 32 and screen 34 is submersed in the dispersion plus milling media mixture in Stage C. The dispersion is then separated from the milling media by vacuum filtration generated by pump 40 through filter probe 30. The filter probe may be controlled manually or mechanically, such as through use of conventional hydraulic lifts or other conventional automation equipment.

After the dispersion is removed from the media, the media may be cleaned in-situ by addition of cleaning solvent and use of the filter probe to remove solvent. Alternatively, the media may be reused for subsequent batches without cleaning.

Preparation of the mixture of slurry and milling media may be accomplished by several methods. By one method, a dispersant may be first dissolved in the liquid vehicle, followed by active solid compound addition to form a uniform premix slurry. This slurry may be added to a bed of milling media, or alternatively, milling media may be added to this slurry to form a slurry/media mixture. By another method, the slurry may be formed by sequential component addition to the media contained in the milling vessel. This method is preferred in cases where the need for multiple vessels is to be avoided.

In preferred embodiments, this invention is practiced in accordance with the wet-milling process described in U.S. Pat. No. 5,145,684 and European Patent Application 498,492. Thus, the wet milling process can be practiced in conjunction with a liquid dispersion medium and surface modifier or dispersant such as described in these publications. Useful liquid dispersion media include water, aqueous salt solutions, ethanol, butanol, hexane, glycol and the like. The surface modifier or dispersants include charged and uncharged surfactants, polymeric stabilizers, etc., and can be selected from known organic and inorganic materials such as described in these publications. The slurry composition preferably ranges from 1 to 70 weight percent of the compound to be milled. The ratio of dispersant to active compound preferably ranges from less than 0.01 to 1. Compounds to be milled are generally solid and preferably crystalline.

The media can range in size up to about 1000 microns. For fine milling, the particles preferably are less than about 300 microns, more preferably less than about 100 microns, and even more preferably less than about 75 microns in size, and most preferably less than or equal to about 50 microns, as such smaller media provides high milling efficiency and enables preparation of minimal particle size. Excellent particle size reduction has been achieved with media having a particle size of about 25 microns, and media milling with media having a particle size of 5 microns or less is contemplated. It is specifically contemplated to use the separation process of the invention in combination with fine milling of compounds useful in imaging with such small media as disclosed in copending U.S. Ser. Nos. 08/248774 and 08/248782 incorporated by reference above, and pharmaceutical compounds as disclosed in copending U.S. Ser. Nos. 08/249781 and 08/249787, also filed May 25, 1994, the disclosures of which are also hereby incorporated by reference.

Media compositions may include glass, ceramics, plastics, steels, etc. In a preferred embodiment, the milling material can comprise particles, preferably substantially spherical in shape, e.g., beads, consisting essentially of a polymeric resin. Polymeric media is preferred due to low density and good chemical and physical stability. In general, polymeric resins suitable for use herein are chemically and physically inert, substantially free of metals, solvent and monomers, and of sufficient hardness and friability to enable them to avoid being chipped or crushed during milling. Suitable polymeric resins include crosslinked polystyrenes, such as polystyrene crosslinked with divinylbenzene, styrene copolymers, polyacrylates such as polymethyl methylacrylate, polycarbonates, polyacetals, such as Delrin™, vinyl chloride polymers and copolymers, polyurethanes, polyamides, poly(tetrafluoroethylenes), e.g., Teflon™, and other fluoropolymers, high density polyethylenes, polypropylenes, cellulose ethers and esters such as cellulose acetate, polyhydroxymethacrylate, polyhydroxyethyl acrylate, silicone containing polymers such as polysiloxanes and the like. The polymer can be biodegradable. Exemplary biodegradable polymers include poly (lactides), poly(glycolids) copolymers of lactides and glycolide, polyanhydrides, poly(hydroxyethyl methacrylate), poly(imino carbonates), poly(N-acylhydroxyproline) esters, poly(N-palmitoyl hydroxyprolino)esters, ethylene-vinyl acetate copolymers, poly(orthoesters), poly(caprolactones), and poly (phosphazenes). The polymeric resins generally have a density from 0.9 to 3.0 g/cm$^3$. Higher density resins are preferred inasmuch as it is believed that these provide more efficient particle size reduction.

The preferred method of making polymeric grinding media is by suspension polymerization of acrylic and styrenic monomers. Methyl methacrylate and styrene are preferred monomers because they are inexpensive, commercially available materials which make acceptable polymeric grinding media. Other acrylic and styrenic monomers have also been demonstrated to work. Styrene is preferred. However, free radical addition polymerization in general, and suspension polymerization in particular, can not be carried to 100% completion. Residual monomers remain in the beads which can leach out during the milling process and contaminate the product dispersion.

Removal of the residual monomers can be accomplished by any number of methods common to polymer synthesis such as thermal drying, stripping by inert gases such as air or nitrogen, solvent extraction or the like. Drying and stripping processes are limited by the low vapor pressure of the residual monomers and large bead sizes resulting in long diffusion paths. Solvent extraction is therefore preferred. Any solvent can be used such as acetone, toluene, alcohols such as methanol, alkanes such as hexane, supercrital carbon dioxide and the like. Acetone is preferred. However, solvents which are effective in removing residual monomers typically dissolve the polymer made from the monomer, or make the polymer sticky and difficult to handle. Therefore, it is preferred to crosslink the polymer and make it insoluble in the solvent which has an affinity for the monomer.

Only enough crosslinker to make the polymer insoluble, typically a few percent, is required but any amount can be used as long as the bead performs adequately as a grinding media. 100% commercially available divinylbenzene (55% assay divinylbenzene) has been found to make beads which break up and contaminate the product. Any monomer with more than one ethylenically unsaturated group can be used such as divinylbenzene and ethylene glycol dimethacrylate. Divinylbenzene is preferred and a copolymer of 20% styrene, 80% commercial divinylbenzene (55% assay) is especially preferred.

Furthermore, the invention can be practiced in conjunction with various inorganic milling media prepared in the appropriate particle size. Such media include zirconium oxide, such as 95% ZrO stabilized with magnesia, zirconium silicate, glass, stainless steel, titania, alumina, and 95% ZrO stabilized with yttrium.

In preferred embodiments, milled compounds can be prepared in submicron or nanoparticulate particle size, e.g., less than about 500 nm. Applicants have demonstrated that particles having an average particle size of less than 100 nm have been prepared in accordance with the present invention. It was particularly surprising and unexpected that such fine particles could be prepared free of unacceptable contamination.

While it is preferred that the milling process be carried out in a batch mode wherein the milling and media separation steps are decoupled in accordance with FIG. 1, the process of the invention may also be practiced in a continuous mode wherein the filter probe is present in the milling chamber during milling, and compound to be milled and liquid medium are continuously introduced into a milling vessel and a dispersion of milled compound is continuously removed from the vessel through the filter probe.

Milling can take place in the milling chamber of any suitable milling apparatus. The milling apparatus may consist of a simple vessel with a high-speed mixer, or any conventional mill designs, including ball mill, stirred-ball mill, sand mill, pebble mill, horizontal media mill, vertical media mill, airjet mill, a roller mill, an attritor mill, a vibratory mill, a planetary mill, bead mill, etc. A high energy media mill is preferred when the milling media consists essentially of the polymeric resin. The mill can contain a rotating shaft. This invention can also be practiced in conjunction with high speed dispersers such as a Cowles disperser, rotor-stator mixers, or other conventional mixers which can deliver high fluid velocity and high shear.

Use of a simple vessel with a high-speed mixer is preferred due to simplicity of design, low cost and ease of use. Preferred vessel geometries include diameter to depth ratios of about 1:1 to 1:10. Vessel volumes may range from less than 1 cc to over 4000 liters. A vessel cover may be used to prevent contamination in the milling chamber and/or allow for pressurization or vacuum. It is preferred that jacketed vessels be used to allow temperature control during milling. Processing temperatures may span the range between the freezing and boiling temperatures of the liquid vehicle used to suspend the particles. Higher pressures may be used to prevent boiling. Common agitator designs may include axial or radial flow impellers, pegs, discs, high-speed dispersers, etc. Mixers employing radial flow are preferred since the provide high media velocity and shear with minimal pumping action which may be detrimental to milling performance. Mixer speeds of 1 to 50 m/sec may be used, although speeds of 20 to 40 m/sec are preferred in simple vessel designs. Milling times may range from about 1 hour to 100 hours or more in such high speed mixing mills, depending on desired particle size, formulations, equipment and processing conditions.

The preferred proportions of the milling media, the compound to be milled, the liquid dispersion medium and any surface modifier can vary within wide limits and depends, for example, upon the particular material selected, the size and density of the milling media, the type of mill selected, etc. Preferred milling media concentrations depend upon the application and can be optimized based on milling performance requirements, and the flow characteristics of the compound to be milled. Preferably, between approximately 30 to 100 percent of the slurry of the compound to be milled resides in the interstitial voids between adjacent media beads. Where the void volume of randomly-packed spheres is approximated to be about 40 percent, the corresponding preferred volume ratio of milling media to slurry in the milling vessel ranges from 0.5 to 1.6. It is preferred that between 60 to 90 percent of slurry reside in media voids to maximize milling efficiency.

The attrition time can vary widely and depends primarily on the compounds to be milled, mechanical means and residence conditions selected, the initial and desired final particle size and so forth.

The process can be carried out within a wide range of temperatures and pressures. The process preferably is carried out at temperatures below that which would cause the compound to be milled to degrade. Generally, temperatures of less than about 30° C. to 40° C. are preferred. Control of the temperature, e.g., by jacketing or immersion of the milling chamber in ice water are contemplated.

While the process can be practiced with a wide variety of compounds to be milled, the compounds need to be poorly soluble and dispersible in at least one liquid medium. By "poorly soluble", it is meant that the compound has a solubility in the liquid dispersion medium, e.g., water, of less that about 10 mg/ml, and preferably of less than about 1 m g/ml. While the preferred liquid dispersion medium is water, the invention can be practiced with other liquid media.

In a preferred embodiment of the invention, the compound to be milled is a compound useful in imaging elements, and is dispersed in water and the resulting dispersion is used in the preparation of the imaging element. The liquid dispersion medium preferably comprises water and a surfactant.

Suitable compounds useful in imaging elements include for example, dye-forming couplers, development inhibitor release couplers (DIR's), development inhibitor anchimeric release couplers (DI(A)R's), masking couplers, filter dyes, thermal transfer dyes, optical brighteners, nucleators, development accelerators, oxidized developer scavengers, ultraviolet radiation absorbing compounds, sensitizing dyes, development inhibitors, antifoggants, bleach accelerators, magnetic particles, lubricants, matting agents, etc.

Examples of such compounds can be found, e.g., in Research Disclosure, December 1989, Item 308119, Sections VII and VIII; Research Disclosure, November 1992, Item 34390; and Research Disclosure, September 1994, item 36544, each published by Kenneth Mason Publications, Ltd., Dudley Annex, 12*a* North Street, Emsworth, Hampshire P010 7DQ, England, as well as the patents and other references cited therein.

In preferred embodiments of the invention, the compound useful in imaging elements is a sensitizing dye, thermal transfer dye or filter dye as described below.

In general, filter dyes that can be used in accordance with this invention are those described in European patent applications EP 549,089 of Texter et and al, EP 430,180 and U.S. Pat. Nos. U.S. Pat. No. 4,803,150; U.S. Pat. No. 4,855,221; U.S. Pat. No. 4,857,446; U.S. Pat. No. 4,900,652; U.S. Pat. No. 4,900,653; U.S. Pat. No. 4,940,654; U.S. Pat. No. 4,948,717; U.S. Pat. No. 4,948,718; U.S. Pat. No. 4,950,586; U.S. Pat. No. 4,988,611; U.S. Pat. No. 4,994,356; U.S. Pat. No. 5,098,820; U.S. Pat. No. 5,213,956; U.S. Pat. No. 5,260,179; and U.S. Pat. No. 5,266,454.

In general, thermal transfer dyes that can be used in accordance with this invention include anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5G H® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); or any of the dyes disclosed in U.S. Pat. Nos. 4,541,830, 4,698,651, 4,695,287, 4,701,439, 4,757,046, 4,743,582, 4,769,360, and 4,753,922.

In general, sensitizing dyes that can be used in accordance with this invention include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

Solid particle dispersions of sensitizing dyes may be added to a silver halide emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, and the like, can be present.

The sensitizing dye may be added to an emulsion comprising silver halide grains and, typically, a hydrophilic colloid at any time prior to (e.g., during or after chemical sensitization) or simultaneous with the coating of the emulsion on a photographic support). The dye/silver halide emulsion may be mixed with a dispersion of color image-forming coupler immediately before coating or in advance of coating (for example, 2 hours). The above-described sensitizing dyes can be used individually, or may be used in combination, e.g. to also provide the silver halide with additional sensitivity to wavelengths of light outside that provided by one dye or to supersensitize the silver halide.

Especially preferred compounds useful in imaging elements that can be used in dispersions in accordance with this invention are filter dyes, thermal transfer dyes, and sensitizing dyes, such as those illustrated below.

D-1

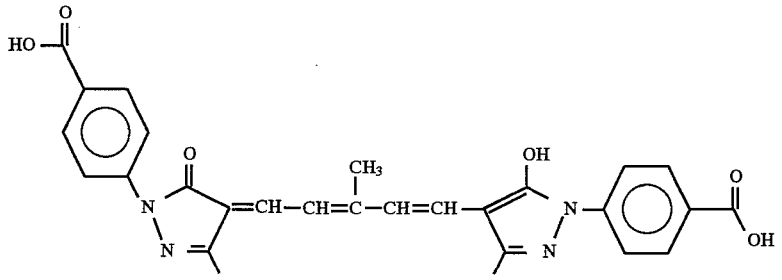

D-2

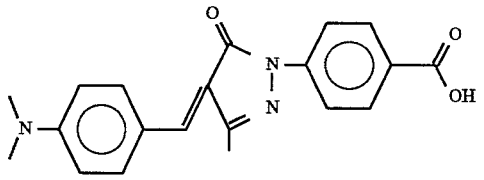

D-3

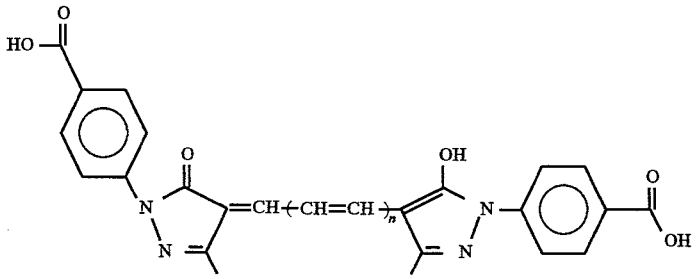

(n = 0)

D-4

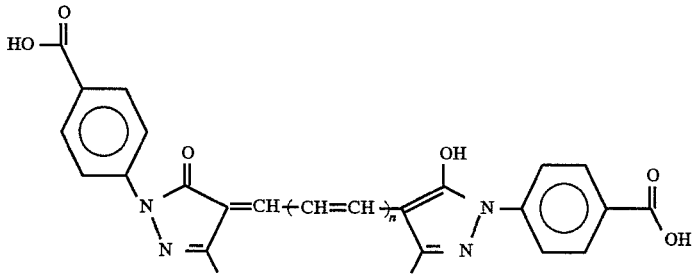

(n = 1)

-continued
D-5
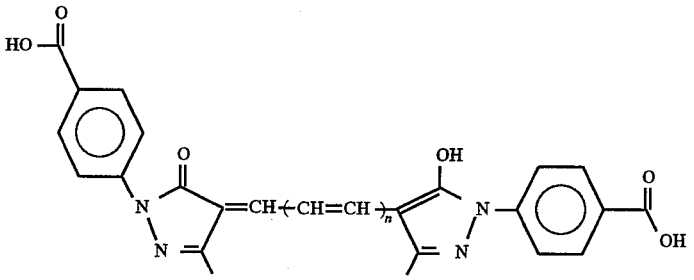
(n = 2)
D-6
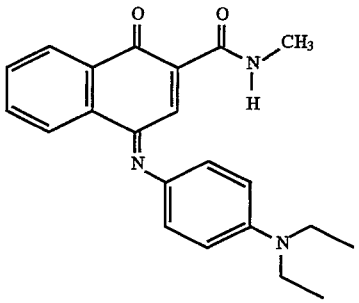
D-7
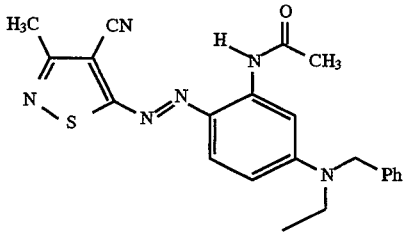
D-8
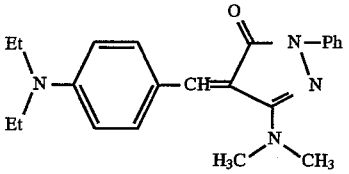
D-9
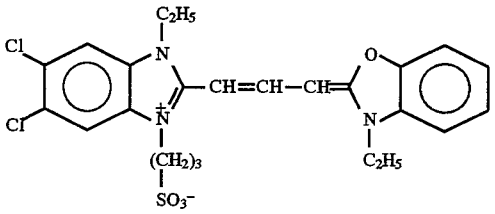
D-10
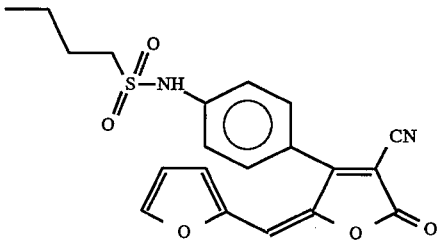

-continued
D-11
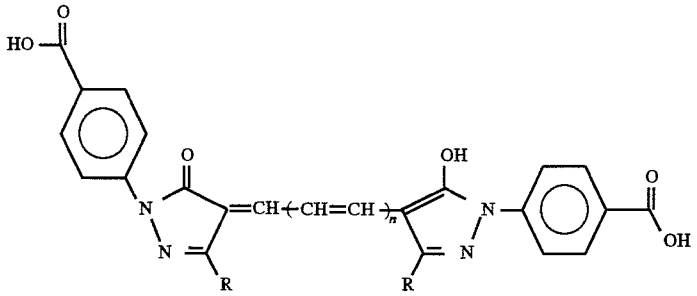
n = 0-2, R = C2–C10 alkyl, aryl
D-12
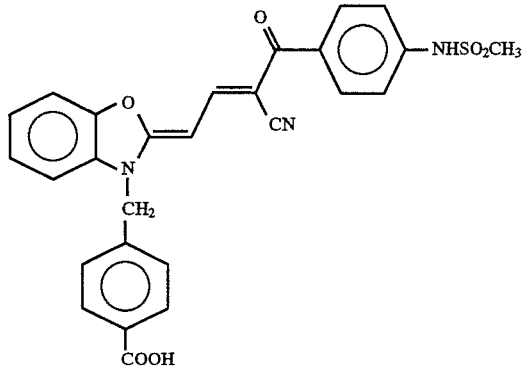
D-13
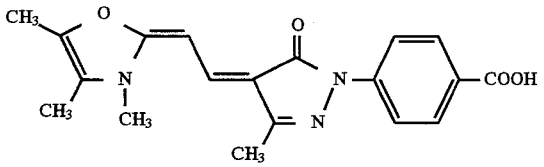
D-14
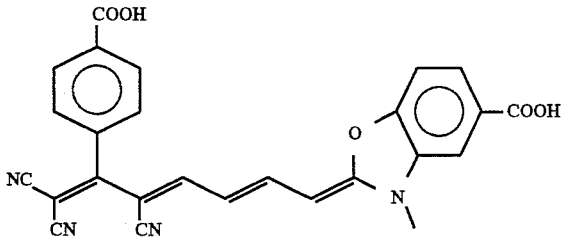
D-15
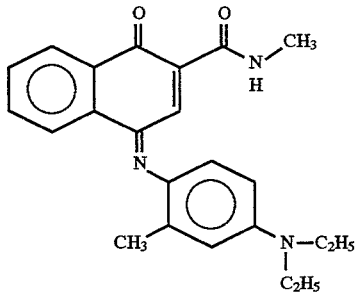
D-16
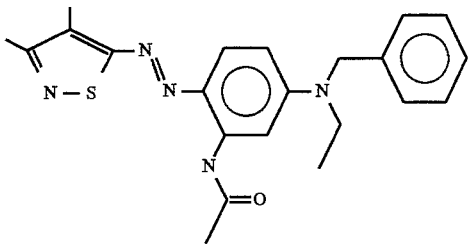

-continued

D-17

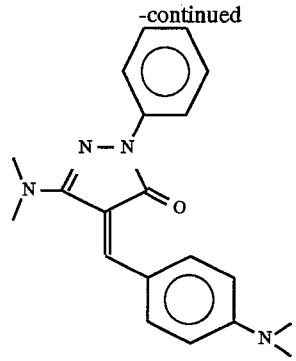

D-18

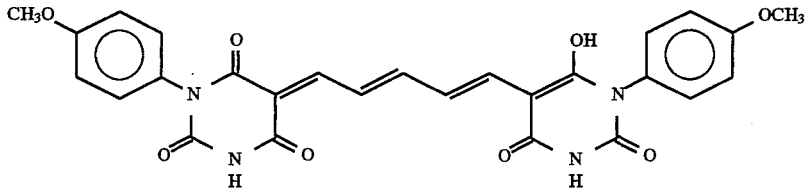

It is to be understood that this list is representative only, and not meant to be exclusive.

The following examples illustrate the process of this invention.

EXAMPLE 1

To a 400 liter vessel (approx. 75 cm diameter by 125 cm depth) was added 135 kg of 50 μm milling media comprising beads of polystyrene crosslinked with divinylbenzene. 108 kg of an aqueous slurry consisting of 25% filter dye D-2 (having an average particle size of about 10 μm) and 1.75% OMT (Oleoylmethyltaurine, sodium salt) surfactant, with the balance water, was added to the media in the vessel. The dispersion/media mixture was agitated for 72 hours at 22 m/sec mixer velocity with a mixer impellor (10' Hockmeyer D-Blade). The mixing system was a Hockmeyer HVI-15 High-Speed Discperser (Hockmeyer Equipment Corporation, Harrison N.J.). At the completion of milling, a weight average mean size of 65 nm was obtained for the D-2 dye particles. The milled dispersion/media mixture was diluted with 162 kg of a 1.33% OMT aqueous solution, reducing the D-2 dye concentration to 10% in the dispersion. The mixer was removed from the dispersion/media mixture, and a vacuum separator filter probe was immersed into the mixture. The filter probe consisted of flexible tubing and a ½' pipe with a porous, cylindrical canister covered with 5 μm filter cloth affixed to the end. A Wilden M0.25 diaphragm pump (Wilden Pump and Engineering Co., Colton Calif.) was used to provide vacuum and discharge the dispersion through the filter and pipe. An initial discharge flow rate of 2 kg/min was achieved. After 24 hrs, 260 kg of dispersion was recovered, approximately 96% yield.

EXAMPLE 2 (comparison)

14.0 kg of 50 μm crosslinked polystyrene media was added to a 50 liter vessel equipped with a high speed mixer and 17.8 cm saw-tooth disperser impeller. To the media was added 1.65 kg of filter dye D-2, 0.1155 kg OMT surfactant and 9.235 kg water, for a total slurry composition of 11.0 kg of 15% dye D-2 and 1.05% OMT surfactant. The mixer to tank diameter ratio was approximately 1:3 and the mixer was centrally positioned in the tank 8.9 cm from the tank bottom. The slurry/media mixture was agitated for 45 hrs at 1800 rpm at 30° C., and a weight average particle size of about 70 nm was achieved. After this time, 5.5 kg of a 2.4% OMT solution was added to dilute the slurry to a final concentration of 10% dye D-2 and 1.5% OMT. The total weight of media and milled slurry was 30.5 kg after dilution.

This mixture was split into 8 aliquots of 3.81 kg each. A Buchner funnel vacuum filtration unit was used to separate the milled slurry from the media. The filter used was a 23 cm diameter 5 μm polyester filter cloth. 8 separate filtrations were required to process the entire batch, with 3 hours labor required for each separate filtration. The following results were obtained:

| Time | Filtration Run | Incremental slurry recovery | % Yield |
|---|---|---|---|
| 3 hrs | 1 | 1301 grams | 8 |
| 6 | 2 | 1847 | 19 |
| 9 | 3 | 1724 | 30 |
| 12 | 4 | 1549 | 39 |
| 15 | 5 | 1642 | 49 |
| 18 | 6 | 1671 | 59 |
| 21 | 7 | 1123 | 66 |
| 24 | 8 | 2081 | 78 |

This media/slurry separation approach was found to be extremely labor and time intensive and resulted in an only moderate total yield of 12938 g versus a 16500 g batch size, or 78%. Significant losses were observed due to the generation of foam in the Buchner funnel apparatus.

EXAMPLE 3

A slurry of dye D-2 was prepared and milled as in example #2. After milling, the vacuum separation approach of the invention was used to recover the milled slurry. The filter probe apparatus consisted of a 5 cm diameter pipe, 60 cm long, with a 3 Mesh screen affixed to the end. This screen was covered by 5 μm polyester filter cloth using a hose clamp for attachment to the pipe. 1 cm diameter flexible tubing was attached to the pipe, and a peristaltic pump was used to generate vacuum. The pipe was immersed in the milled slurry/media mixture so that the filter was near the bottom of the vessel. The pump speed was adjusted to a achieve appx. 3 m $H_2O$ vacuum, and the slurry was pumped from the vessel. The filter probe was periodically manually repositioned during the filtration to maximize recovery of milled slurry. The following results were obtained:

| Time | Accumulated Slurry Recovery | % Yield |
|---|---|---|
| 0.25 hrs | 3630 g | 22 |
| 0.5 | 7425 | 45 |
| 1 | 11220 | 68 |
| 1.5 | 12375 | 75 |
| 3 | 13695 | 83 |
| 6 | 14850 | 90 |
| 8 | 15345 | 93 |

As apparent, the total recovery was significantly higher than in comparison example #2, and the total separation time was reduced.

The invention has been described in detail with particular reference to preferred embodiments thereof, but it is to be understood that variations and modifications can be effected within the spirit and scope of the invention.

What is claimed is:

1. A process for forming a dispersion of solid particles of a compound comprising:

(a) forming a slurry of a liquid medium, milling media, and a solid compound, (b) contacting said milling media and said compound in a milling chamber of a milling vessel to reduce the solid compound to a desired average particle size to form a dispersion of milled solid particles in said liquid medium, and (c) separating said dispersion of milled particles from said milling media in said milling chamber by vacuum filtration through a removable filter probe immersed in the slurry, wherein milling step (b) is performed in the absence of the removable filter, which removable filter is immersed into the slurry in the milling chamber after the solid compound is reduced to a desired particle size.

2. The process of claim 1, further comprising diluting the slurry between milling step (b) and separating step (c) by addition of a liquid medium.

3. The process of claim 1 wherein the milling media has an average particle size of less than 300 microns.

4. The process of claim 1 wherein the milling media has an average particle size of less than 100 microns.

5. The process of claim 1 wherein the milling media has an average particle size of about 50 microns.

6. The process of claim 1 wherein the solid compound is milled to an average particle size of less than 1 micron.

7. The process of claim 1 wherein the solid compound is milled to an average particle size of less than 100 nanometers.

8. The process of claim 1 wherein the solid compound is milled to an average particle size of less than 50 nanometers.

9. The process of claim 1 wherein the milling media has an average particle size of less than 100 microns, and the solid compound is milled to an average particle size of less than 100 nanometers.

10. A process for forming a dispersion of solid particles of a compound comprising:

(a) forming a slurry of a liquid medium, milling media, and a solid compound, (b) contacting said milling media and said compound in a milling chamber of a milling vessel to reduce the solid compound to a desired average particle size to form a dispersion of milled solid particles in said liquid medium, and (c) separating said dispersion of milled particles from said milling media in said milling chamber by vacuum filtration through a removable filter probe immersed in the slurry, wherein the filter probe is not physically attached to the milling vessel and is moved throughout the slurry.

11. The process of claim 1 wherein the filter probe comprises a filter screen covering an end of a conduit, the filter screen comprising openings which are larger than the desired dispersion particle size and smaller than the milling media particle size, and step (c) comprises immersing the filter screen in the slurry.

12. The process of claim 10, wherein the milling and separating are performed in a continuous process, wherein the compound and liquid medium are continuously introduced into the milling chamber, and the milled compound of a desired particle size and liquid medium are continuously removed from the milling chamber.

13. The process of claim 1, wherein said milling media are beads of a polymeric resin.

14. The process of claim 13, wherein said polymer is polystyrene crosslinked with divinylbenzene.

15. The process of claim 1, wherein said compound is a compound useful in imaging elements.

16. The process of claim 15, wherein said compound is selected from the group consisting of dye-forming couplers, development inhibitor release couplers (DIR's), development inhibitor anchimeric release couplers (DI(A)R's), masking couplers, filter dyes, thermal transfer dyes, optical brighteners, nucleators, development accelerators, oxidized developer scavengers, ultraviolet radiation absorbing compounds, sensitizing dyes, development inhibitors, antifoggants, bleach accelerators, magnetic particles, lubricants, and matting agents.

17. The process of claim 1, wherein contacting step (b) is performed by agitating the milling media and compound in a milling chamber with a high speed mixer comprising at least one impeller.

18. The process of claim 10 wherein the milling media has an average particle size of less than 100 microns.

19. The process of claim 10 wherein the solid compound is milled to an average particle size of less than 100 nanometers.

20. The process of claim 10 wherein the milling media has an average particle size of less than 100 microns, and the solid compound is milled to an average particle size of less than 100 nanometers.

* * * * *